United States Patent [19]

Johnsen

[11] Patent Number: 4,729,228

[45] Date of Patent: Mar. 8, 1988

[54] SUCTION LINE FLOW STREAM SEPARATOR FOR PARALLEL COMPRESSOR ARRANGEMENTS

[75] Inventor: Clifford N. Johnsen, La Crosse, Wis.

[73] Assignee: American Standard Inc., New York, N.Y.

[21] Appl. No.: 920,641

[22] Filed: Oct. 20, 1986

[51] Int. Cl.[4] ..... F25B 1/10

[52] U.S. Cl. ..... 62/510; 137/561 A; 417/426

[58] Field of Search ..... 62/196.2, 510; 417/286, 417/426, 427; 137/561 A; 138/26, 37, 39

[56] References Cited

U.S. PATENT DOCUMENTS

| | | | |
|---|---|---|---|
| 253,908 | 2/1882 | Brady | 138/37 |
| 598,327 | 2/1897 | Schlemmer | 138/37 |
| 933,279 | 9/1909 | Welch | 138/37 X |
| 2,164,011 | 6/1939 | Hilborn | 137/561 A X |
| 2,486,141 | 10/1949 | Follo | 138/37 |
| 3,008,692 | 11/1961 | Gerard | 138/37 X |
| 3,068,904 | 12/1962 | Moody | 138/37 |
| 3,386,262 | 6/1968 | Hackbart et al. | 62/469 |
| 3,785,169 | 1/1974 | Gylland, Jr. et al. | 62/468 |
| 3,894,302 | 7/1975 | Lasater | 138/37 X |
| 4,162,546 | 7/1979 | Shortell | 138/37 X |
| 4,472,949 | 9/1984 | Fujisawa et al. | 62/473 |
| 4,578,188 | 3/1986 | Cousino | 137/561 A X |

*Primary Examiner*—William E. Tapolcai

*Attorney, Agent, or Firm*—William J. Beres; David L. Polsley; Robert J. Harter

[57] ABSTRACT

The stream of suction gas and entrained oil flowing from the evaporator in a parallel compressor refrigeration system is directed into a flow separator where it diverges and is expanded into a separation chamber of increased cross-sectional area. A takeoff conduit has an inlet end disposed generally in the center of the separation chamber which faces into the suction gas flow stream. Because of the location and size of the cross-sectional area of the inlet end of the takeoff conduit, a larger portion of the suction gas flow stream and oil entrained therein bypasses the takeoff conduit inlet than enters it. The separation chamber is in flow communication, at its outlet end, with the shell of the one of the compressors which is designated to receive a majority of the suction gas and oil entrained therein. The takeoff conduit is in flow communication with the other of the compressors.

6 Claims, 4 Drawing Figures

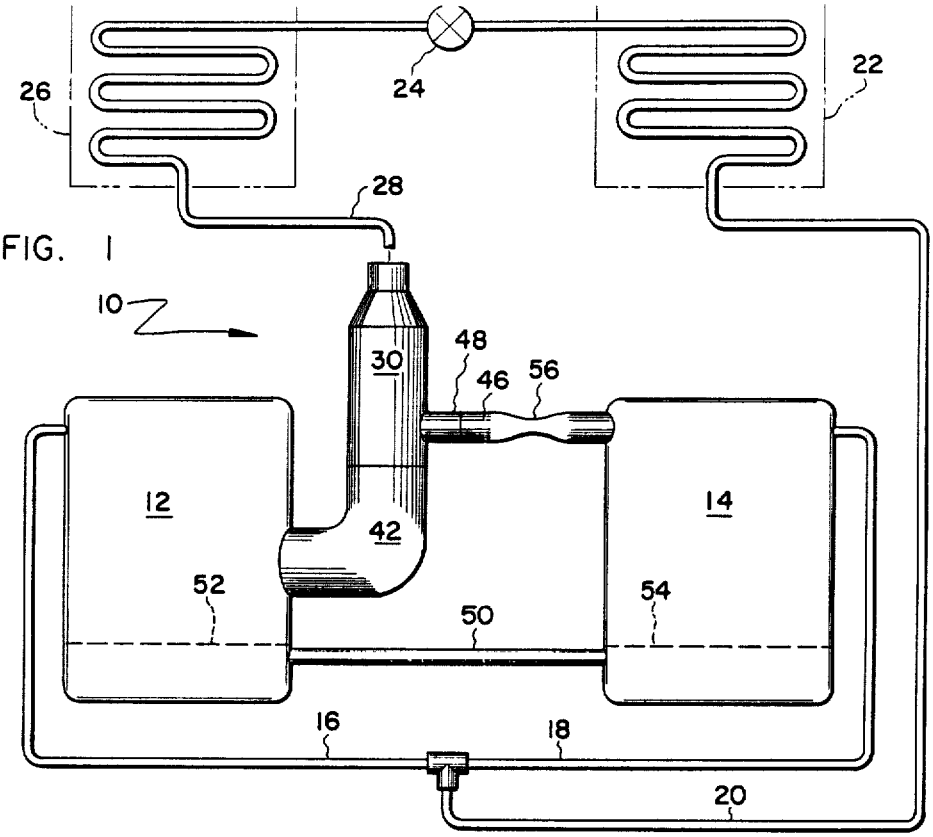
FIG. 1
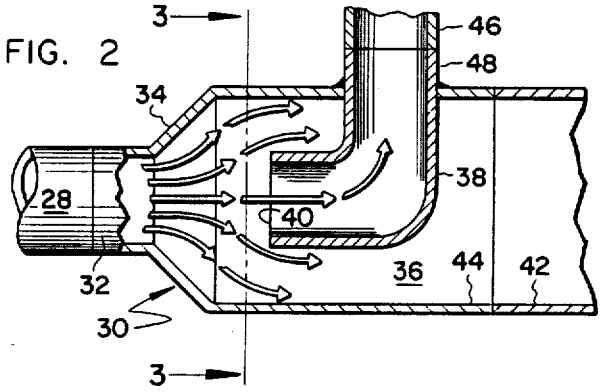
FIG. 2
FIG. 3
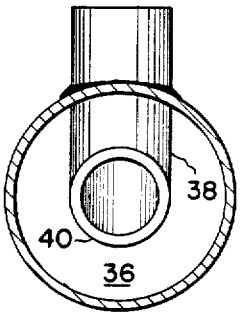
FIG. 4
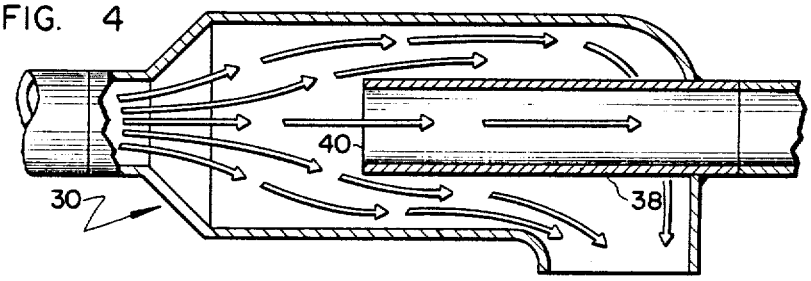

SUCTION LINE FLOW STREAM SEPARATOR FOR PARALLEL COMPRESSOR ARRANGEMENTS

FIELD OF THE INVENTION

The present invention relates to the selective delivery of suction gas and oil to parallel compressors in a refrigeration circuit. More specifically, the present invention relates to apparatus for delivering unequal amounts of suction gas and entrained oil to the compressors in a parallel compressor installation wherein one of the compressors is designated to receive a majority of the suction gas and entrained oil.

BACKGROUND OF THE INVENTION

It is well documented that when parallel low-side compressors are employed in closed refrigeration systems the tendency exists for one of the compressors to become starved for lubricating oil. A lowside compressor is one in which suction gas is essentially dumped into the interior of the shell of the compressor.

The closed shell of a low-side refrigeration compressor houses a motor-compressor unit and generally defines a lubricating oil sump at its bottom. A portion of the motor-compressor lubricating oil, which collects and is stored in the sump area, becomes entrained in the suction gas which dumps into the shell of the compressor and travels with the suction gas into, through and out of the compressor. The entrained oil flows with the refrigerant into the remainder of the refrigeration system and is carried back into the shell of the compressor with the suction gas as it returns from the evaporator.

When suction gas is returned from the evaporator to the compressors in a refrigeration system having parallel low-side compressors it is inevitable that one of the compressors will draw more suction gas, and consequently more entrained lubricating oil, into its shell than will the other compressor. Over a period of time and unless otherwise accounted for, the oil in the sump of one of the compressors will be depleted while the shell of the other compressor will become overfilled with oil. Provision must therefore be made to equalize the oil levels in the parallel compressors of such refrigeration systems and to maintain those levels in an equalized state during system operation. Failure to do so can result in the catastrophic failure of the compressor whose oil supply becomes depleted.

Many attempts have been made to solve the oil equalization problems associated with compressors in parallel compressor refrigeration systems. Many such attempts have been based upon the mechanical pumping of oil from one compressor sump to the other. Other solutions to the oil equalization problem focus upon equalizing the pressures in the sumps of parallel compressors to insure that equal amounts of suction gas, and therefore entrained lubricating oil, are continuously and independently delivered to the shell of each compressor. Both of these solutions are relatively complex and are generally subject to mechanical breakdown.

Because of the relative complexity of such systems and the catastrophic results which can occur upon their failure, efforts have been made to provide oil equalization arrangements in parallel compressor refrigeration systems which are more mechanically simple and therefore more inherently reliable than the previously mentioned oil level equalization schemes. Exemplary in this regard are U.S. Pat. Nos. 3,386,262 to Hackbart and 3,785,169 to Gylland, the former being assigned to the assignee of the present invention.

In Gylland a parallel compressor lubrication scheme is taught which is based upon the delivery of the entire volume of suction gas from the evaporator in a refrigeration system to a single one of the two parallel discharge compressors therein. Suction gas is then communicated from the shell of the first compressor to the shell of the second compressor. Gylland teaches, therefore, a series input, parallel output arrangement. Because of this arrangement, the shell of the compressor to which suction gas is directly delivered is always at a higher pressure, when the system is in operation, than the shell of the downstream compressor. The higher pressure in the first compressor is employed to drive oil from the sump of that compressor to the sump of the second compressor. Most significant in the Gylland arrangement is the avoidance of parallel suction paths into the shells of parallel output compressors.

In Hackbart, refrigerant is directed from the evaporator in a refrigeration system to a "T" or "Y" shaped coupling which has a branch line connection. Because of the coupling configuration, the shell of a first of the compressors receives a majority of the suction gas and therefore, a majority of the lubricant entrained therein. By virtue of the delivery of a majority of the suction gas to it, the shell of the first compressor is maintained at a higher pressure than that which will be found in the shell of the second compressor when the first compressor is in operation. The second compressor relies upon the receipt of oil from the shell of the first compressor through an oil equalization conduit. Oil is driven from the shell of the first compressor through the equalization conduit by the elevated pressure in the shell of the first compressor. However, the coupling in Hackbart is configured so as to also allow for the delivery, through a conduit connected to the branch line connection of the coupling, of refrigerant gas and some lubricating oil directly to the shell of the second com- pressor.

In the Hackbart coupling the branch line connection which leads to the shell of the second compressor is completely out of line with the flow path of suction gas and oil which enters the coupling from the evaporator. The line leading to the first compressor from the coupling is directly in line with the suction gas flow path. No provision exists by which suction gas and/or oil is positively acted upon and diverted into the branch line which leads from the coupling to the second compressor. Thus, there is no facility in the Hackbart coupling which positively acts upon the suction gas flow stream to insure the direct delivery of at least a portion of the oil entrained in the suction gas to the sump of the second compressor. Further, because of the inertia of the suction gas flow stream and the radical direction change required of it to enter into the branch line leading to the second compressor, the Hackbart coupling tends to promote the disentrainment of the heavier oil from that portion of the suction gas which is able to accomplish the extreme change in direction of travel which is required before it can enter the branch line.

It has been determined that somewhat more active rather than passive oil management is preferable in parallel compressor refrigeration systems than is accomplished by the Hackbart coupling. Yet it has long been recognized that the reliance upon mechanically operated apparatus such as pumps to accomplish active oil management can unnecessarily complicate a refrigeration system and lead to the catastrophic failure of a compressor therein should a mechanical malfunction occur. Therefore, the need continues to exist for apparatus which positively provides for and encourages the direct delivery of suction gas and entrained oil to both of the compressors in a parallel compressor refrigeration system yet which maintains the mechanical simplicity of a system not subject to a malfunction of a mechanical nature.

SUMMARY OF THE PRESENT INVENTION

It is an object of the present invention to positively provide for the direct path delivery of refrigerant gas and entrained lubricating oil to both of the compressors in a parallel compressor refrigeration system.

It is a further object of the present invention to provide for such direct path suction gas delivery in a manner which insures the concurrent direct delivery of lubricant to each of the compressors in predetermined amounts.

It is a still further object of the present invention to provide for the positive and direct delivery of suction gas and entrained oil to the shells of parallel compressors in a refrigeration system in a selective fashion so as to result in the delivery of a greater amount of suction gas and entrained oil to the shell of a designated one of the parallel compressors than to the shell of the other of the compressors.

Finally, it is an object of the present invention to accomplish the delivery of a greater amount of suction gas and entrained oil to the shell of one compressor than to the shell of the other of a manifolded pair of parallel flow path refrigeration compressors by means of the employment of apparatus which is not, of itself, subject to mechanical malfunction yet which positively acts upon the suction gas flow stream to ensure the direct delivery of a portion of the suction gas and entrained oil to each of the compressors.

The objects of the present invention as set forth immediately above and others which will become apparent when the associated specification, drawing and claims are considered are accomplished by a selective suction line flow stream separator which acts positively on the suction gas flow stream delivered from the evaporator in a parallel compressor refrigeration system to cause the direct delivery of unequal amounts of suction gas and entrained oil to the shells of the compressors thereof.

The selective suction line flow stream separator of the present invention is a structure which is connected at an inlet end to the line which communicates low pressure vaporized gas and entrained oil from the evaporator in a parallel compressor refrigeration system. The separator structure transitions through a diverging tapered section which opens into a separation chamber having a diameter larger than the diameter of the inlet end of the separator. A takeoff conduit penetrates the separation chamber and includes an inlet end which faces generally into the suction gas flow stream. The takeoff conduit connects to a suction line which leads directly to the one of the two manifolded pair of compressors which is designated to receive a lesser portion of the suction gas and entrained oil delivered from the evaporator in the system.

The downstream end of the separation chamber of the flow stream separator is connected to a suction line which leads to the compressor designated to receive a majority of the suction gas and oil from the evaporator. By controlling the location and cross-sectional area of the inlet end of the takeoff conduit in the separation chamber it can be insured that a majority of the suction gas and entrained oil delivered to the separator is delivered to the designated one of the compressors which is to receive the larger amount of suction gas and oil. It can further be assured that the other of the compressor receives a direct though lesser supply of suction gas and oil.

In operation, suction gas and entrained oil is delivered from the evaporator to the inlet end of the flow stream separator of the present invention. As the suction gas flow stream enters the tapered portion of the apparatus which opens into the separation chamber, it tends to diverge and to hug the inner walls of the apparatus. A majority of the gas and entrained oil will therefore migrate to and be found at the outer periphery of the separation chamber after having passed through the expansion section of the separator. However, a portion of the suction gas and entrained oil entering the separator will continue into the separation chamber in an essentially linear fashion and will proceed to enter the inlet end of the takeoff conduit.

Due to the tendency of the fluid stream to resist separation from the walls of the flow stream separator at the boundary layer locations, a majority of the suction gas and entrained oil will be carried past the inlet end of the takeoff conduit, out of the separator apparatus and to the first of the designated compressors. However, due to the size and position of the takeoff conduit inlet, the direct delivery of at least a predetermined though lesser portion of the suction gas flow stream to the secondary compressor is assured.

BRIEF DESCRIPTION OF THE DRAWING

FIG. 1 is a schematic illustration of a refrigeration system employing the selective suction line flow stream separator of the present invention.

FIG. 2 is a cross-sectional view of the flow stream separator of the present invention.

FIG. 3 is a sectional view taken along line 3—3 of FIG. 2.

FIG. 4 illustrates, in cross section, another embodiment of the flow stream separator of the present invention.

DESCRIPTION OF THE PREFERRED EMBODIMENT

Referring initially to FIG. 1, refrigeration system 10 includes a manifolded pair of compressors 12 and 14 each of which has a discharge line, 16 and 18 respectively, through which compressed refrigerant gas is communicated to a common discharge conduit 20. The compressed refrigerant gas is delivered through conduit 20 to condenser 22 and next to an expansion valve 24 from where it is metered to evaporator 26 of the system. As has been noted, the refrigerant stream discharged from the compressors carries along with it a portion of the lubricating oil which is delivered initially into the motor-compressor units by an oil delivery system or by the suction gas which is drawn into the compressors from their shells in operation. This oil is carried through the refrigeration system and is returned from the evaporator to the shells of the compressors.

Refrigerant gas is communicated from evaporator 26 through suction line conduit 28 and to the selective flow stream separator 30 of the present invention. Referring concurrently to FIGS. 1 through 3, oil-carrying refrigerant gas enters inlet end 32 of separator 30 which is attached, as by brazing, to suction line conduit 28. The refrigerant travels through inlet end 32 of the flow stream separator essentially as it has traveled through suction line conduit 28 due to the identical cross-sectional areas and configurations of the conduit and the separator inlet.

Due to the divergent nature of next encountered flow stream expansion section 34, the cross-sectional area of which increases in a downstream flow direction, the flow path of the refrigerant gas stream entering the expansion section tends to diverge and to hug the interior wall of the expansion section. However, the portion of the suction gas flow stream which is found in the central area of the inlet end of separator 30 will continue to flow in a generally linear fashion through the expansion section since the enlargement of the flow area in the expansion section will have somewhat less of an effect on that portion of the suction gas flow stream and the lubricant entrained therein than on the portion which is proximate the interior walls of the separator inlet. Therefore, a central portion of the gas stream and the lubricant entrained therein will remain generally in the central portion of both expansion section 34 and separation chamber 36, to which expansion section 34 is attached at its downstream end, during the course of its travel into the separation chamber.

Disposed within separation chamber 36 of flow stream separator 30, somewhat downstream of expansion section 34, is takeoff conduit 38 which has an inlet end 40 facing into the suction gas flow stream. Inlet end 40 of takeoff conduit 38 will preferably be mounted so as to be disposed generally in the central portion of the separation chamber 36 as is best illustrated in FIG. 3. Because of the effect of passing the suction gas flow stream through diverging expansion section 34 and because of the relative cross-sectional areas of separation chamber 36 and inlet end 40 of takeoff conduit 38, a majority of the oil and suction gas which enters separation chamber 36 will flow around and bypass inlet end 40 of takeoff conduit 38. However, a predictable and preselected amount of suction gas and entrained oil will flow directly into inlet end 40 of the takeoff conduit.

By the controlled selection of the location and cross-sectional area of inlet end 40 of the takeoff conduit, the amount of suction gas and oil which flows thereinto can be positively influenced and predetermined for all compressor operating conditions. Clearly, the larger the cross-sectional area of inlet end 40 of the takeoff conduit with respect to the cross-sectional area of separation chamber 36, the larger will be the portion of suction gas and entrained oil which is delivered into the takeoff conduit. Likewise, if inlet end 40 of the takeoff conduit is displaced toward a side wall of the separation chamber, as opposed to being centered, more oil will be delivered through it as inlet end 40 of the takeoff conduit will be located in a more oil-rich environment within the separation chamber. Thus, flow stream separator 30 acts selectively yet positively on the suction gas flow stream delivered from the evaporator in refrigeration system 10 to control the direct delivery of predetermined unequal amounts of suction gas and lubricant to the shells of each of the parallel compressors disposed in that system.

It is contemplated, as in prior refrigeration systems employing parallel compressors, that one of the compressors in refrigeration system 10 will be designated to operate at a slightly elevated shell pressure and will therefore be the compressor designated to receive a majority of the suction gas being delivered from the evaporator in the system. In the case of refrigeration system 10, compressor 12 is that compressor. Therefore, suction line conduit 42, which leads to compressor 12, is connected to outlet end 44 of separation chamber 36 of flow stream separator 30 and suction line 46, by which suction gas and entrained gas is delivered to compressor 14, is connected to outlet end 48 of the takeoff conduit. The employment of separator 30 therefore results in the controlled delivery of a majority of the suction gas and oil which flows through the refrigeration system directly to compressor 12 while an equally controlled but lesser amount of suction gas and oil is delivered directly to compressor 14.

As noted above, in operation the interior of the shell of compressor 12 will be at a pressure which is slightly higher than the pressure found in the shell of compressor 14. This pressure is employed in conjunction with an oil level equalization tube 50, which connects the oil sumps of the shells of the compressors at their nominal oil levels indicated at 52 and 54, to drive excess oil from the shell of compressor 12 into the sump of compressor 14 thereby equalizing sump oil levels in the compressors. A two-source supply of lubricant is thus guaranteed compressor 14 which consists of the direct delivery of a predetermined amount of oil from flow stream separator 30 and the delivery of excess oil from the sump of compressor 12. As has been previously known, suction line 46, which leads to compressor 14, may be crimped as necessary, as is illustrated at 56, to restrict the flow of suction gas to compressor 14 and to promote a larger pressure differential between the shells of the compressors. However, by virtue of the positive and precise control over the delivery of suction gas to each of the compressor shells which can be accomplished by the employment of flow stream separator 30, such crimping should not generally be required.

Referring now to FIG. 4, in which identical reference numerals identify like previously identified separator components, an alternative embodiment of the flow stream separator of my invention will be seen. The embodiment of FIG. 4 differs essentially in the disposition of takeoff conduit 38 with respect to its penetration into separation chamber 36. In the embodiment of FIG. 4, takeoff conduit 38 is a straight conduit section which faces directly into the suction gas flow stream but in which the obstruction caused by the portion of the takeoff conduit which passes through the sidewall of the separator 30 is eliminated. The differences in the embodiments are not extremely significant since the obstruction represented by conduit 38 in the preferred embodiment, illustrated in FIGS. 1 through 3, occurs downstream of inlet end 40 of the takeoff conduit. Therefore the impact of the configuration of the separator apparatus downstream of centered inlet end 40 of the takeoff conduit is not severe since once the suction gas and entrained oil flows past inlet end 40 of the takeoff conduit it has little chance of moving upstream against the flow stream and back into the inlet end 40 of the takeoff conduit.

It will be appreciated that the physical orientation of separator 30 can be varied in accordance with system needs. That is, the separator can be mounted horizontally or vertically or can be otherwise disposed as necessary. Preferably, however, the suction gas stream will not flow vertically upward into the separator apparatus since such disposition of the separator could lead to the clogging of inlet 32 by oil which might seek to settle in the area of the inlet under the influence of gravity. Further, it will be appreciated that separator 30 can be employed with a wide variety of compressor types, including reciprocating and scroll type compressors. Finally, while two embodiments of my invention have been specifically described it should be understood that the scope of my invention is limited only by the claims which follow.

What is claimed is:

1. A multiple compressor refrigeration system comprising:

a first low-side compressor having a shell which defines an oil sump;

a second low-side compressor having a shell which defines an oil sump;

an oil level equalization conduit connecting the oil sumps of said first and said second compressors for flow;

an evaporator;

suction line conduit means connected to said evaporator for conducting a suction gas flow stream from said evaporator, said flow stream being a stream comprised of vaporized refrigerant gas in which oil is entrained; and means for unequally apportioning said gas stream to the shells of said first and second second compressors by causing said gas stream to diverge, said means for unequally apportioning having (i) a housing, connected to said suction line conduit mens, which defines both an expansion section and a separation chamber, said separation chamber having a cross-sectional area greater than the cross-sectional area of said suction line conduit menas and said expansion section being upstream of said separation chamber and causing said flow stream of diverge upstream thereof, said separation chamber being in flow communication at a downstream end with the interior of the shell of said first compressor and (ii) a takeoff conduit having a distal end, said takeoff conduit penetrating said housing and extending into said separation chamber so that said distal end is located in and spaced from the wall of said separation chamber downstream of said expansion section, said distal end facing generally into the flow stream conducted from said evaporator to said separation chamber the cross-sectional area of said distal end of said distal end of said takoff conduit being sized so that a majority of the contents of the gas flow stream communicated from said evaporator into said separation chamber bypass the distal end of said takeoff conduit.

2. The refrigeration system according to claim 1 wherein said distal end of said takeoff conduit is generally centered in said separation chamber.

3. The refridgeration system according to claim 2 wherein said separation chamber has a circular cross-section.

4. The refrigeration system according to claim 3 wherein said expansion section is a hollow truncated cone connected at a downstream end to the portion of said housing which defines said separation chamber and at upstream end to receive gas flow from said evaporator, the upstream end of said expansion section having a smaller cross-sectional area than the downstream end.

5. The refrigeration system according to claim 4 wherein the portion of said takeoff conduit extending into said separation chamber is a straight conduit portion.

6. The refrigeration system according to claim 4 wherein the portion of said takeoff conduit extending into said separation chamber penetrates a side wall of said housing.

* * * * *

UNITED STATES PATENT AND TRADEMARK OFFICE

CERTIFICATE OF CORRECTION

PATENT NO. : 4,729,228

DATED : March 8, 1988

INVENTOR(S) : Clifford N. Johnsen

It is certified that error appears in the above-identified patent and that said Letters Patent is hereby corrected as shown below:

In The Specification:

Column 2, line 40,"com- pressor" should be --compressor--.

Column 5, lines 44-45, "cros-ssectional" should be --cross-sectional--.

In The Claims:

Column 7, Claim 1, line 27, delete the first "second" and insert --said--.

Column 7, Claim 1, line 36, delete "of" and insert --to--.

Column 8, Claim 1, line 10, after "chamber" insert --,--.

Column 8, Claim 1, line 11, after the first "end" delete "of said distal end".

Column 8, Claim 4, line 26, after "at" insert --an--.

Signed and Sealed this

Fifth Day of July, 1988

*Attest:*

DONALD J. QUIGG

*Attesting Officer*

*Commissioner of Patents and Trademarks*